United States Patent [19]

Lejondahl et al.

[11] Patent Number: 4,862,674

[45] Date of Patent: Sep. 5, 1989

[54] THERMALLY INSULATED CONTAINER

[76] Inventors: Lars-Erik Lejondahl, Herkulesgatan 15, S-641 34 Katrineholm; Björn G. Karlsson, Boställsgatan 54, S-583 31 Linköping; Curt Björk, Konsistoriegatan 21B, S-582 34 Linköping, all of Sweden

[21] Appl. No.: 111,536

[22] Filed: Oct. 23, 1987

Related U.S. Application Data

[63] Continuation-in-part of Ser. No. 822,408, Dec. 17, 1985, abandoned, and a continuation-in-part of Ser. No. 10,491, Feb. 3, 1987, abandoned.

[51] Int. Cl.[4] ..... B65B 31/02; B65B 23/00

[52] U.S. Cl. ..... 53/432; 53/440; 53/449; 53/472; 53/474; 53/399

[58] Field of Search ..... 220/420, 421, 422, 423, 220/424, 411, 412; 206/524; 62/457; 53/399, 432, 440, 449, 465, 472, 474

[56] References Cited

U.S. PATENT DOCUMENTS

| | | | |
|---|---|---|---|
| Re. 17,826 | 10/1930 | Thomson | 220/422 |
| 624,168 | 5/1899 | Brun | 220/412 |
| 3,009,601 | 11/1961 | Matsch | 220/424 |
| 3,420,363 | 1/1969 | Blickensderfer | 206/524 |
| 3,423,817 | 1/1969 | Bobo | 53/449 |
| 3,810,367 | 5/1974 | Peterson | 62/457 |
| 4,055,268 | 10/1977 | Barthel | 220/423 |
| 4,281,500 | 8/1981 | Mueller | 53/465 X |

*Primary Examiner*—John Sipos

*Attorney, Agent, or Firm*—Cushman, Darby & Cushman

[57] ABSTRACT

A thermally insulated container is provided, mainly intended for storing and transporting material such as vaccine, biological material or the like, which requires storing at a constant temperature during several months. The container comprises an outer and an inner vessel each of which is hermetically sealed and defining an outer and an inner space respectively. The material to be kept at said temperature is arranged in the inner space. A solid-to-liquid phase transforming material is arranged in the inner space completely surrounding said material. A composite insulation fills out the outer space and comprises layers of a porous material under vacuum alternating with layers of a heat reflecting material. The insulation encloses the inner vessel on all sides and the outer space is free from structural connections extending between the inner and outer vessels, so that thermal bridges between the inner and outer vessels are effectively prevented.

7 Claims, 4 Drawing Sheets

THERMALLY INSULATED CONTAINER

REFERENCE TO RELATED APPLICATIONS

This is a continuation-in-part of application No. 06/822,408 filed Dec. 17, 1985 (now abandoned) and a continuation-in-part of application No. 07/010,491 filed Feb. 3, 1987 (now abandoned).

BACKGROUND OF THE INVENTION

The present invention refers to a thermally insulated container for storing and transporting material such as vaccine, biological material or the like requiring a substantial constant temperature during a time of several months.

When storing and/or transporting biological and chemical materials one has to consider that these materials will change with time, if they are not stored at a certain, often low, temperature. This is mainly a problem in the developing countries, where the transport of vaccines, serum, blood blood plasma and some enzyme compounds is carried out in an environment, of rather high temperatures. In addition the transport routes are often long and in bad condition, which means that the transport will last long. In the developing countries it is also unusual that vaccines and the like are manufactured in the country, but the demand is almost always covered by import from different industrialized countries. This means that the transport routes will become still longer.

More than 90% of all vaccines require storing at temperatures between +2° and +8° C. and are destroyed rather fast at higher temperatures and also by freezing. As vaccines and the like are very sensitive and as the transport route are long and hard, it is estimated that about 50% of all vaccines are destroyed along the transport route before they reach the final user in the developing country. Today the vaccines are transported between different stations, of which at least the bigger ones are equipped with cooling and freezing plants. These cooling and freezing plants are powered with electric power or alternatively by means of liquid petroleum gas or photogene and they are rather sensitive to disturbance. Due to the defective electricity supply network in the developing countries it is for example not unusual with long power failures.

With the cooling plants which exist today it is therefore important that the transport is carried out as fast as possible. This means that vaccines are flown as far as possible into the developing countries and a net of intermediate storing stations is built up. This of course is expensive and requires a well organized chain of cooling plants.

STATE OF THE ART

A number of different inventions are known within the field of storing or transport containers intended to be kept at a low constant temperature. British patent GB No. 1,006,746 for instance thus discloses a container for transport of material which requires cooling by means of a gas in liquid state. The container comprises an insulating external container in which a porous container body is located and in the interior of which the material, which should be cooled can be introduced. The container body is prepared with slowly boiling liquid gas which slowly evaporates whereby cold is emitted. This invention is primarily intended for biological material which should be kept at a very low temperature, well below the freezing point, and which therefore requires a liquid gas for its cooling. The device is furthermore designed to allow the gas generated during the boiling to escape through evacuation canals. If the gas cannot be evacuated, the boiling will stop and the cooling will cease. Owing to the fact that only a limited quantity of liquid gas can be contained in the container this container is only intended to keep the biological material cooled during a short time before new liquid gas must be supplied. An important drawback at this invention is that during long transports trained operators must be at hand and regularly refuel liquid gas which has to be carried along.

Another refrigerated container is described in the German Pat. No. 2,825,111 and refers to a container which is used to cool a metering device during a limited time in a surrounding with high temperatures. The cooling device is primarily intended to be used during measurement inside tunnel ovens and the like, and it comprises mainly an inner and an outer cylinder located in an insulated container. Between the inner and outer cylinder is arranged a heat-storing material which communicates with the surroundings via a steam exhaust tube and a filling tube. The inner device is again located in an insulated container filled with insulating material. This invention is thus intended for very high surrounding temperatures, which occur e.g. in ovens. There is furthermore provided a heat storing material which when exposed to heat evaporates to steam which escapes through a relief tube. The device must always be located in a certain way where the filling tube and the tube for evacuation of steam is directed upwards, in order to work. It is also only intended to maintain a certain temperature in its inner space during a short period of time.

In the U.S. Pat. No. 3,009,601 there is disclosed an apparatus insulated by a composite insulation material comprising a low heat conductive material and reflective shields or radiation barriers, such as aluminum-coated plastic film. The reflective shields are preferably perforated so as to permit gas to move radially through the insulation layers towards an evacuation connection or a gas trapping means such as an adsorbent or getter. The presence of radial holes in the reflective shields however involves a reduced insulating power of the material. The refrigerant is a liquid gas, which means that there is an evacuation means extending from the inner container and out through the outer container. This evacuation means provides a thermal bridge which reduces the insulation capacity of the apparatus.

SUMMARY OF THE INVENTION

The purpose of the present invention is to provide a thermally insulated container which can be used as a disposable container and which is cheap to manufacture. Another purpose of the invention is that the container should be robust and protect its contents against damages caused by external influence in the form of impacts and blows. A further purpose is that the inner space of the container shall be kept at an mainly constant temperature or within a certain temperature interval during a long period of time. The container shall use a passive system, e.g. no energy shall be supplied from outside to maintain the determined temperature. By means of a container according to the invention it should be possible to neglect the time the transport will take, e.g. it should be possible to transport the container by boat instead of using airfreight which makes the transport cheaper. This is achieved according to the invention thereby, that the container comprises: an outer and an inner vessel each of which is hermetically sealed, said inner vessel being arranged inside said outer vessel; the material to be kept at the predetermined temperature and a solid-to-liquid phase transforming refrigerant material being arranged in said inner vessel, said phase transforming material surrounding said material to be kept at the predetermined temperature; and a multi-layer insulation filling the space between said inner and outer vessel and comprising layers of a porous material under vacuum alternating with layers of a heat reflecting material, said insulation layer enclosing said inner vessel on all sides and said space between said inner and outer vessel is free of structural connections extending between said inner and outer vessel so that any thermal bridges therebetween are effectively prevented.

DESCRIPTION OF EMBODIMENTS

Figure 1:
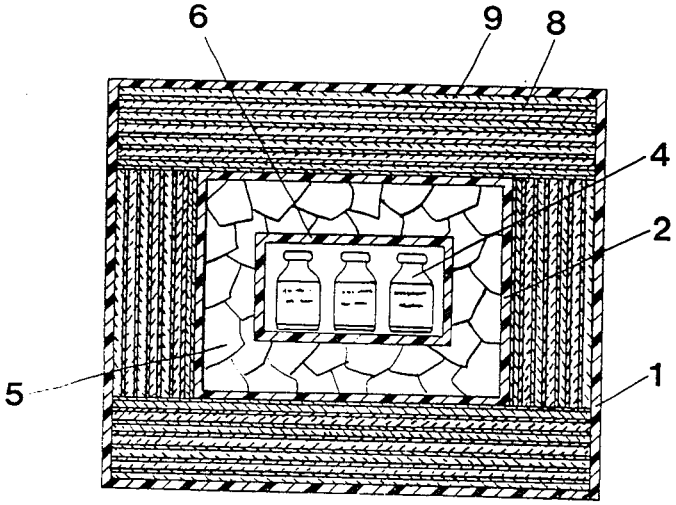
FIG. 1 shows a cross section of a container according to the invention.

In FIG. 1 is shown a thermally insulated container according to the invention. It consists of an outer vessel 1 made of stainless steel material and it is designed as a square box in order to facilitate stacking and storing. The size of the outer vessel can of course be varied within wide margins but can e.g. be about 50×50×50 cm. A container of this dimension has a transport weight of about 15–20 kg. In the space inside the outer vessel is located an inner vessel 2 at a certain distance from the outer vessel 1. Also this inner vessel 2 may consist of stainless steel. The outer and inner vessel 1, 2 are designed to be diffusion proof in order to reduce the pressure increase and to maintain a low heat conductivity. Between the outer and the inner vessel 1, 2 thereby is formed a space, which is filled with a composite insulation, comprising layers 8 of a porous material, alternating with layers 9 of a heat reflecting material, such as metallic foil disposed substantially transversely to the direction of heat flow. To increase the insulating ability of the insulating material this space has been put under vacuum by evacuation. In order to obtain this it is required, that the outer and the inner vessels are sealed e.g. by a weld after packing the material, the cooled object 4, which is to be transported or stored. In order to remove any residues of gas in the porous material one surface of the foil material 9 is covered with a getter material 10. Vaporized getter material is sprayed on one surface of the foil material 9, e.g. by a sputtering procedure, and is allowed to condense thereon.

The material, the cooled object, which shall be stored and/or transported at a constant temperature, is located in the intermediate space of the inner box shaped vessel 1. The material, which can consist of a daily ration of vaccine, e.g. about 1–2 kg can be enclosed in a further box 6 of plastic or similar material or it may be enclosed in shrink film 7 (see FIG. 2). The space between the package 6, 7 of the cooled object and the inside of the inner vessel 2 is filled with a solid-to-liquid phase transforming material 5, which e.g. can be salt or ice of distilled water. If ice is used as phase transforming material, vaccine of the above mentioned quantity, can be kept cooled during a very long time. Calculations and practical tests have shown that the cooled object can be kept at a temperature just about 0° C. during several months. When the phase transforming material has been completely transformed to its other, warm, phase, the temperature in the container however will increase rapidly.

In the insulated container according to the invention there is no need of evacuating gas or the like because the phase transforming material will not transform to gas. This means the essential advantage that there is no need of arranging any thermal bridges in the form of tubes or the like through which heat can be transported to the inner space of the container from the surroundings. As the cooled object is enclosed in a phase transforming material such as ice water or salt impacts and blows are effectively absorbed whereby the cooled object is well protected during the transport.

Figure 2:
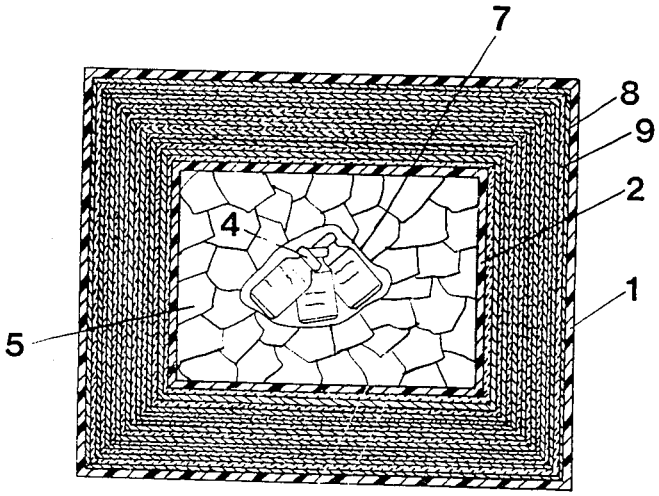
FIG. 2 shows a further embodiment of the invention.

In FIG. 2 is shown an alternative embodiment according to the invention. The cooled object 4 has been packed by means of shrink film 7 only and put into the inner space 5 of the inner vessel 2. The composite layers of porous material 8 and reflecting foil 9 is wound about the inner vessel 2 and fill out the space between the outer and inner vessels 1 and 2.

It is important that the casing 1,2 is diffusion sealed. Vacuum and getter material 10 is used to reduce the heat leakage further.

Figure 3:
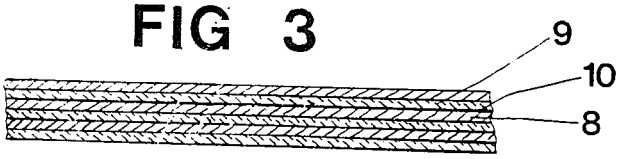
FIG. 3 shows a schematic cross-section through the insulation material according to the invention.

FIG. 3 shows a schematic cross section through the composite layers of insulating porous material 8 and reflecting foil 9, which on one surface is covered with getter material 10. The exposed surface of the getter material is thereby large and the getter material is located close to the gas residues in the porous material 8. Examples of getter materials are Ba, Ca and Mg.

The cooled object can also be located together with the phase transforming material in an inner cylindric metal vessel. Around this container a number of, e.g. twenty, insulating layers are arranged. The insulating layers can e.g. consist of layers of glass fibres and aluminum foil. It is important at the application that the insulating layers fit tightly around the inner vessel and that no thermal bridges are formed in possible joints. The metal vessel and insulation layers are thereafter placed in an outer, e.g. cylindric vessel, which could be provided with a reinforcement at the inside, and the outer container is evacuated to a substantial vacuum.

Figure 4:
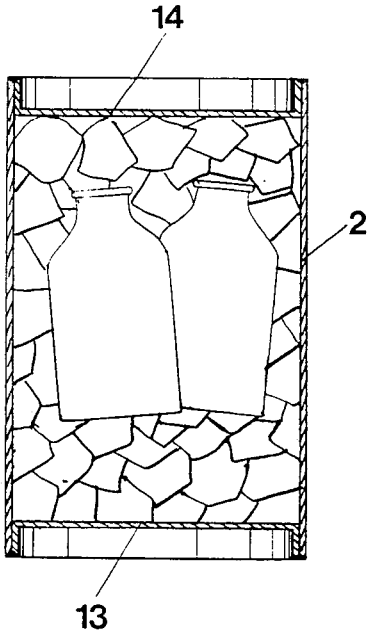
FIG. 4 shows a cross-section through the inner vessel filled with the cooled objects and phase transforming material.

Both the inner and outer vessels may consist of a container of the type tin cans, which make the transport container cheap to manufacture as earlier already known technology may be used. In FIG. 4 is shown an inner vessel 2 of cylindric shape and having a bottom 13, and cover 14. The cover 14 is attached to the vessel 8 by electron beam welding after the vessel 8 has been filled with cooled objects 4 and phase transforming material. Electron beam welding is preferred while it generates only little heat.

Figure 5:
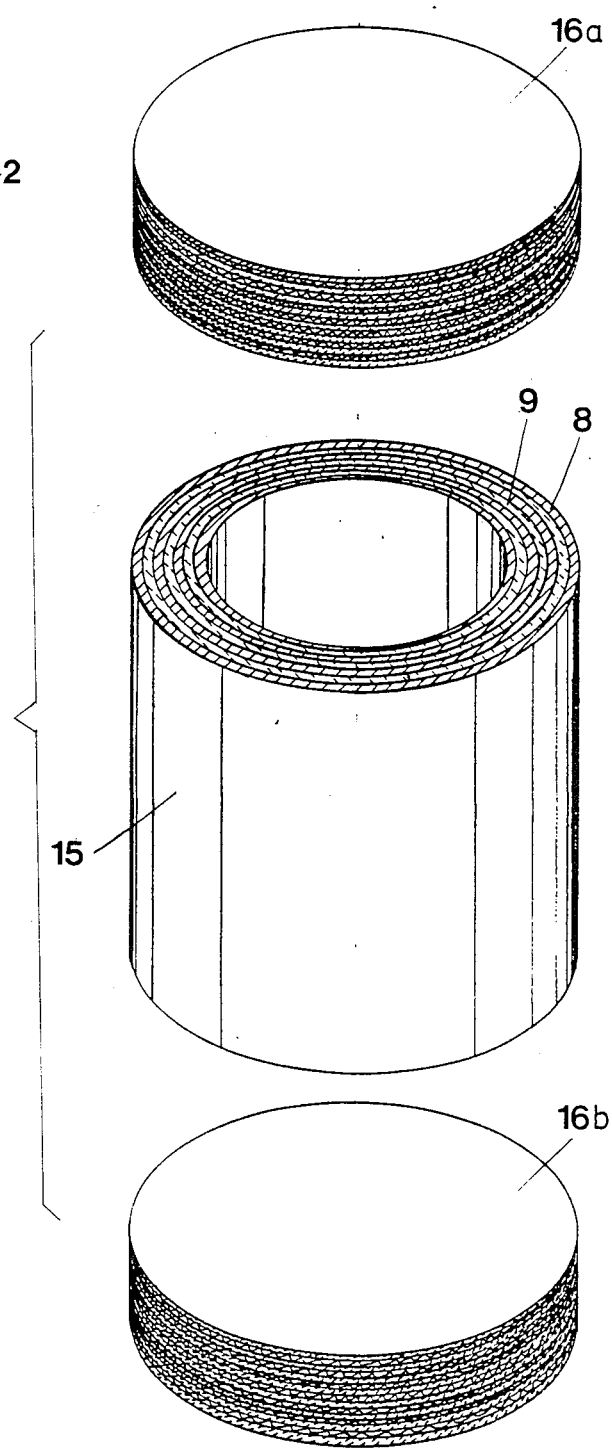
FIG. 5 shows a perspective insulating material in the form of a cylinder and two covers.

FIG. 5 shows the insulating material in the form of a cylinder 15 and two covers 16*a* and 16*b*, the cylinder 15 being formed by winding a composite material according to FIG. 3 until the desired member of layers is obtained. It is pointed out that the insulation material is shown only very schematically and the thickness of the layers 8,9 is strongly exaggerated for the sake of clarity.

The covers 16 may be formed by punching through a desired number of layers of the material. All these operations have to be performed in vacuum so that the porous material will be substantially free from air. The cylinder 15 and covers 16 can then be vacuum packed in a foil or film material, after which they can be transported and stored under normal pressure.

Figure 6:
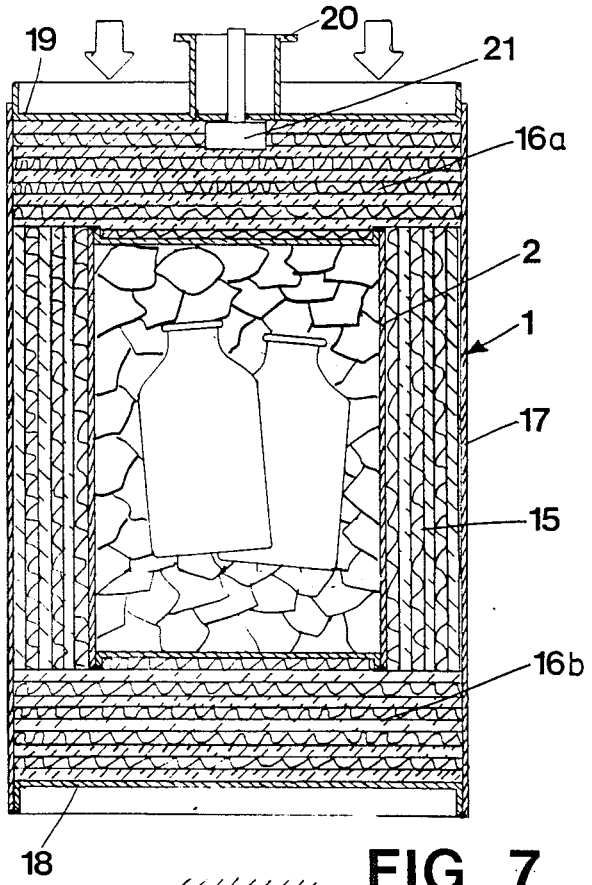
FIG. 6 shows a cross-section through the complete container consisting of inner and outer vessels with insulating material therebetween.

In FIG. 6 is shown the complete container comprising the inner vessel 2, the insulating material 8, 9 in the form of the cylinder 15 and the covers 16 arranged outside and completely enclosing the inner vessel 2 and an outer vessel 1 arranged outside the insulating material. The outer vessel 1 can just like the inner vessel 2 be of the type a tin can, preferably of stainless steel, and consists of a cylinder 17, a bottom 18 and a cover 19, which is attached to the cylinder 17 by electron beam welding after the insulated inner vessel 2 has been placed in the outer vessel 1, so that a hermetically sealed outer vessel is provided. The insulating material is compressed when the cover 19 is pressed thereon (FIG. 6), at which a very tight connection between the covers 16 and the cylinder 15 is provided. All these operations are performed in vacuum.

The multilayer insulation should have a thickness of at least 2 cm (about 20 layers each of porous material and heat reflecting material).

The outer vessel 1 is further provided with an evacuation connection 20 and a so called getter pump 21 for supplying a getter material to the insulating material in order to remove any residues of gas in the porous material 8. The getter material is activated by electric heating for a short period.

Figure 7:
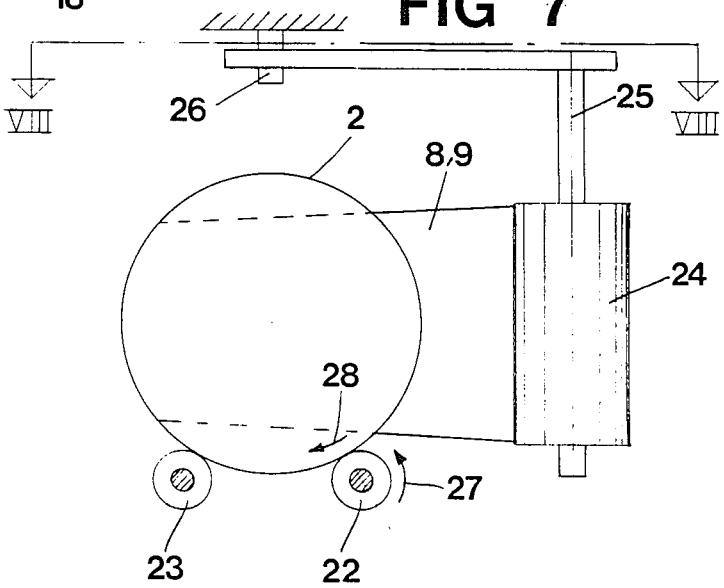
FIG. 7 shows a section through a device for wrapping insulating material about the inner cylindrical vessels.
Figure 8:
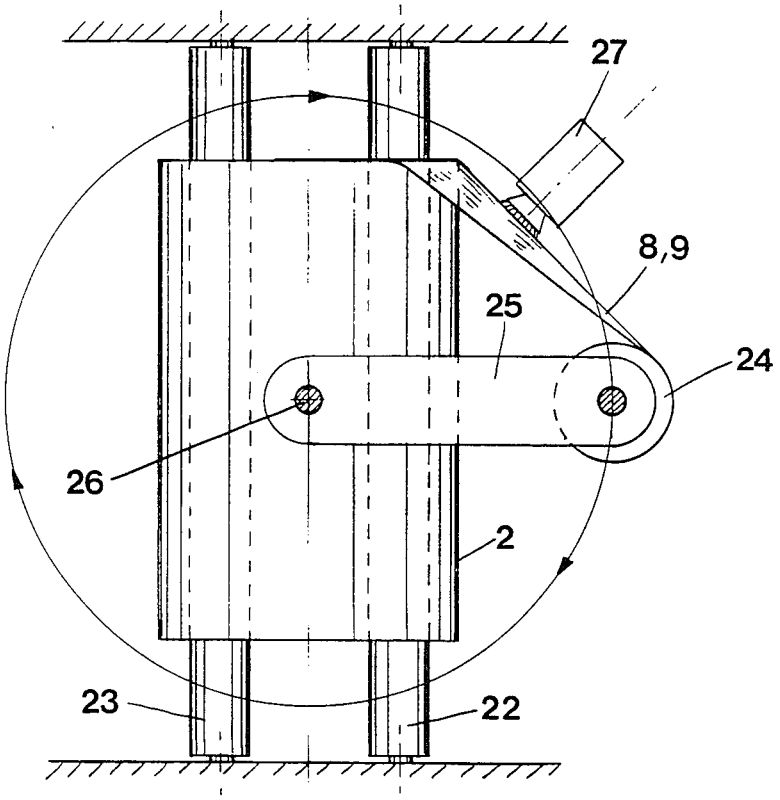
FIG. 8 is a section according to the line VIII—VIII in FIG. 7.

In FIGS. 7 and 8 is disclosed a device for wrapping the cylindric inner vessel 2 with and completely enclosing it in insulating material. The device comprises a drive roll 22 and idler roll 23 supporting the cylindric vessel 2. The insulating material, which in this case may comprise a double-layer material, a porous material 8 and a heat reflecting material 9, is arranged on a supply roll 24. The supply roll 24 is supported by a cantilever 25, which is rotatable about a vertical axle 26 arranged just above the vessel 2 which is to be wrapped. When the cantilever 25 is rotated the supply roll 24 will perform a circular path about the vessel 2 and wrap it with insulating material from end-to-end. The drive roll 22 is simultaneously driven to rotate in the direction of the arrow 28 (FIG. 7), which causes the cylinder to rotate about its longitudinal axis in the direction of the arrow 28.

This simultaneous rotation of the vessel 2 to be wrapped will cause the insulating material 8, 9 to be wrapped about the vessel 2 in a substantially spiral configuration with overlapping layers. The wrapping is continued until the insulating material completely surrounds the surfaces of the vessel 2 including its curved side surfaces and end surfaces with a desired number of layers. The insulated vessel 2 is then put in an outer vessel 1. All these operations have to be performed in the vacuum. In FIG. 8 is shown a device 27 for spraying vaporized getter material on the surface of the foil material, as it is unwound from the supply roll 24. Instead of making the supply roll perform a circular path about the vessel 2, the latter may together with the rolls 22 and 23 be carried on a turntable, which is adapted to rotate in the plane of the floor, so that the vessel 2 will be rotated end to end.

In order to avoid that the heat reflecting material 9 will form an unbroken path extending between the outer and inner vessels 1 and 2 and which would make a thermal bridge, the heat reflecting layer 9 is appropriately interrupted at certain intervals leaving gaps with only porous material 8. The end edges of the interrupted heat reflecting layer may be e.g. glued to the porous layer.

Laboratory tests have been performed in a high vacuum plant equipped with an oil diffusion pump. The outer vessel consisted of a cylindric vessel of stainless steel, the cover of which was sealed with a rubber seal in a bolted joint. A solid equivalent body of iron was used as a replacement for the inner vessel. The temperature of the equivalent was measured with a thermoelement. The temperature increase per unit of time was determined as a function of the total pressure of the system. The following results were obtained.

| Total pressure | Insulation | Temperature increasce (°C./h) |
|---|---|---|
| atmospheric pressure | no | 4 |
| $2 \cdot 10^{-4}$ | no | 0.67 |
| atmospheric pressure | yes | 2 |
| $2 \cdot 10^{-2}$ | yes | 0.18 |
| $2 \cdot 10^{-4}$ | yes | 0.05 |

These results, which only should be used as a relative comparison, shows the vacuum technical demands which should be fulfiled by the inner and outer vessels. A preferred solution is to use welded constructions of stainless steel.

In another test the thermal load was determined for an equivalent body of aluminum, which was insulated with a multilayer insualtion of the kind previously described and placed in an outer cylindric vessel of stainless steel. The total pressure in the outer vessel was below $2 \cdot 10^{-4}$ torr. The effect of the heat radiated towards the inner container was about 0,2 W. This means that for an amount of ice of about 3–4 kg a transport time of 3–4 months would be possible.

The invention is of course not limited to the above disclosed embodiments, but a number of alternative embodiments is possible within the scope of the claims.

We claim:

1. A method of manufacturing a thermally insulated container for storing and transporting material such as vaccine, biological material requiring a substantial constant temperature during a time of several months, comprising the steps of:

filling a first can-shaped vessel with a solid-to-liquid phase-transforming refrigerant material;

placing a material to be cooled in said first vessel so that said phase-transforming material surrounds said material to be cooled on all sides;

hermetically sealing said first vessel;

arranging a multi-layer insulating comprising layers of porous material under vacuum alternating with layers of a heat reflecting material about said first vessel, so that it encloses said first vessel on all sides;

placing the resultingly insulated first vessel in a second can-shaped vessel; and hermetically sealing said second vessel;

the arranging of said insulation, the placing of said insulated first vessel in a second vessel and the hermetic sealing of said second vessel being performed under a substantial vacuum, so that the space between the inner first vessel and the outer second vessel will be substantially free from air, and avoiding provision of any structural connections extending between said inner and outer vessels, so that any thermal bridges therebetween are effectively prevented.

2. A method as claimed in claim 1, wherein said hermetic sealing is provided by electron beam welding.

3. A method as claimed in claim 1, wherein a getter material for absorbing any residues of gas in the porous material is applied on one surface of said heat reflecting material, so that said surface is at least partially covered with said getter material.

4. A method as claimed in claim 1, wherein said inner and outer vessels are of a substantially cylindrical shape and that a cylindrical body of the multilayer insulation fitting about said inner vessel and two covers of the multilayer insulation fitting on said cylindrical body are manufactured in vacuum, and that said cylindrical body and covers are applied about said inner vessel in vacuum so that said insulation encloses the inner vessel on all sides.

5. A method as claimed in claim 4, wherein the cover of the outer vessel is attached and sealed to the outer vessel under pressure, so that a compression of the insulating material and a tight connection between said cylindric body and covers of insulation material is provided.

6. A method as claimed in claim 1, wherein said insulation is wrapped about said inner vessel from end-to-end in a substantially spiral configuration with overlapping layers until a desired number of layers is obtained.

7. A method as claimed in claim 3, wherein said getter material is applied by spraying onto said surface.

* * * * *